US011536160B2

(12) United States Patent
Nishikawa

(10) Patent No.: US 11,536,160 B2
(45) Date of Patent: Dec. 27, 2022

(54) STEAM TURBINE

(71) Applicant: MITSUBISHI HEAVY INDUSTRIES COMPRESSOR CORPORATION, Tokyo (JP)

(72) Inventor: Tomoyuki Nishikawa, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/651,467

(22) Filed: Feb. 17, 2022

(65) Prior Publication Data

US 2022/0268176 A1 Aug. 25, 2022

(30) Foreign Application Priority Data

Feb. 22, 2021 (JP) ..... JP2021-025915

(51) Int. Cl.
*F01D 25/24* (2006.01)
*F01D 25/26* (2006.01)
*F01D 25/14* (2006.01)

(52) U.S. Cl.
CPC ..... *F01D 25/24* (2013.01); *F01D 25/26* (2013.01); *F01D 25/145* (2013.01); *F05D 2220/31* (2013.01)

(58) Field of Classification Search
CPC ..... F01D 25/10; F01D 25/145; F01D 25/24; F01D 25/26; F05D 2220/31
See application file for complete search history.

(56) References Cited

U.S. PATENT DOCUMENTS 4,102,598 A * 7/1978 Stock ..... F01D 25/26 415/220
6,171,053 B1 * 1/2001 Ulma ..... F01D 25/145 415/110
2011/0097201 A1 * 4/2011 Gafner ..... F01D 25/26 415/213.1
2021/0108538 A1 * 4/2021 Onishi ..... F01D 25/30

FOREIGN PATENT DOCUMENTS

JP 4046774 B2 2/2008

* cited by examiner

*Primary Examiner* — Jesse S Bogue
(74) *Attorney, Agent, or Firm* — Osha Bergman Watanabe & Burton LLP

(57) ABSTRACT

A steam turbine includes a rotor that rotates about an axis, a casing that covers the rotor from an outer side in a radial direction with respect to the axis, and a cover disposed outside the casing to form a hollow path portion between an outer peripheral surface of the casing and the cover, in which the cover is connected to a negative pressure source configured to put the path portion into a vacuum state, and the path portion is a space isolated from a space inside the casing.

3 Claims, 3 Drawing Sheets

STEAM TURBINE

BACKGROUND OF THE INVENTION

Field of the Invention

The present disclosure relates to a steam turbine.

Priority is claimed on Japanese Patent Application No. 2021-025915, filed Feb. 22, 2021, the content of which is incorporated herein by reference.

Description of Related Art

For example, as disclosed in Patent Document 1, a steam turbine rotationally drives a rotor provided in a casing by steam supplied from a boiler.

The steam turbine transmits the rotation of the rotor to operate a generator or the like.

SUMMARY OF THE INVENTION

In a steam turbine as described above, a casing becomes hot due to steam flowing into the casing during operation. In order to enhance the operational efficiency of the steam turbine, it is preferable to suppress heat dissipation from the casing.

In order to solve such a problem, for example, the casing is also covered with a heat insulating material. However, the heat insulating material is applied after the installation of the steam turbine in order to suppress damage to the heat insulating material. Due to this, there is a problem in that the installation work of the steam turbine is prolonged.

The present disclosure provides a steam turbine capable of effectively suppressing heat dissipation from the casing during the operation of the steam turbine to enhance operational efficiency while improving workability.

A steam turbine according to an aspect of the present disclosure includes a rotor that is configured to rotate about an axis, a casing that covers the rotor from an outer side in a radial direction with respect to the axis, and a cover disposed outside the casing to form a hollow path portion between an outer peripheral surface of the casing and the cover, in which the cover is connected to a negative pressure source configured to put the path portion into a vacuum state, and the path portion is a space isolated from a space inside the casing.

According to the steam turbine of the present disclosure, heat dissipation from the casing can be effectively suppressed during the operation of the steam turbine to enhance operational efficiency while improving workability.

DETAILED DESCRIPTION OF THE INVENTION

In the following, an embodiment for implementing a steam turbine according to the present disclosure will be described with reference to the accompanying drawings. However, the present disclosure is not limited to this embodiment.

Configuration of Steam Turbine

Figure 1:
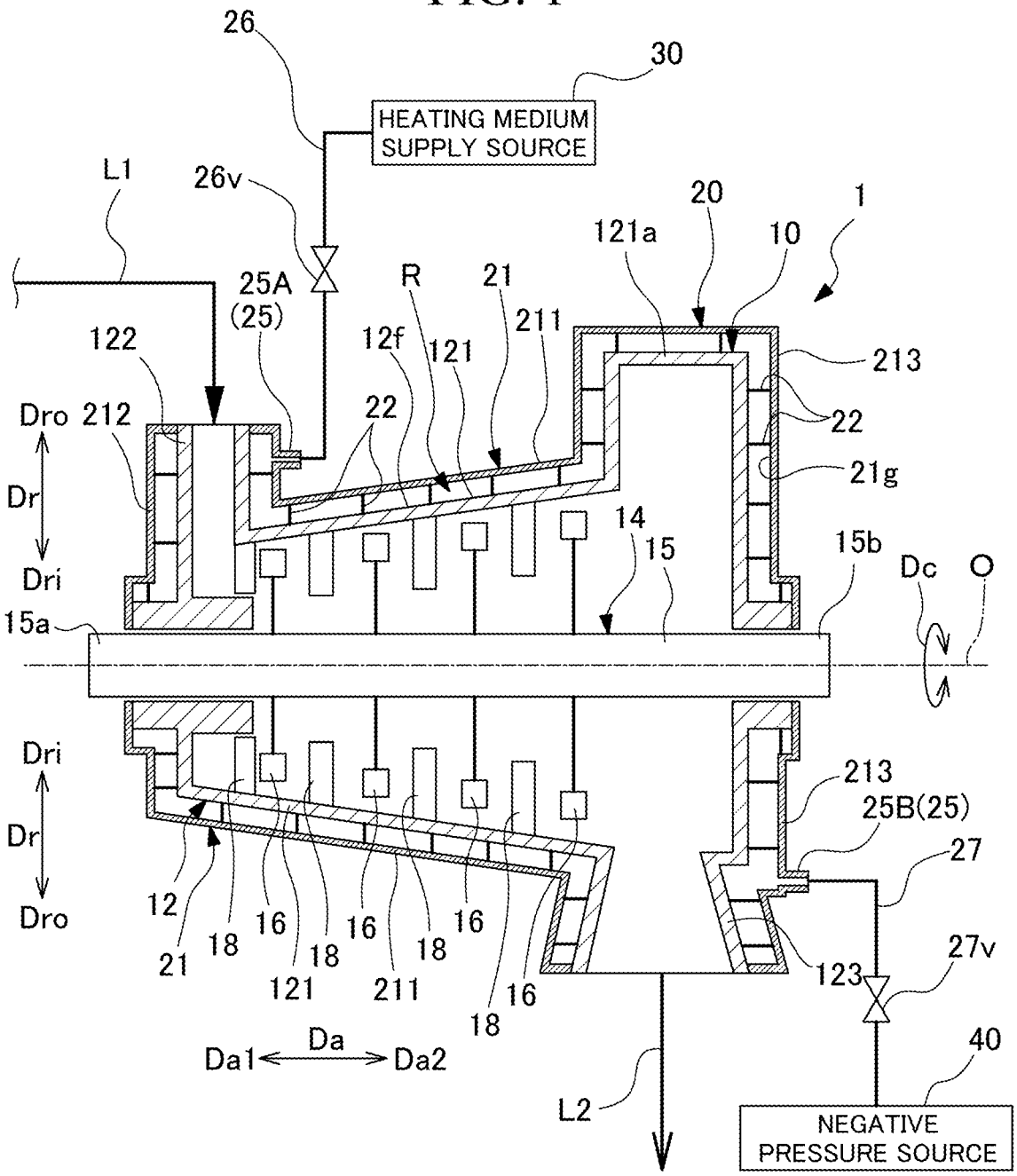
FIG. 1 is a cross-sectional view showing a schematic configuration of a steam turbine according to an embodiment of the present disclosure.

As shown in FIG. 1, a steam turbine 1 includes a steam turbine body 10 and a cover 20.

Configuration of Steam Turbine Body

The steam turbine body 10 includes a casing 12 and a rotor 14. The casing 12 integrally includes a casing body 121, an inlet nozzle 122, and an outlet nozzle 123. The casing body 121 is formed in a cylindrical shape extending in an axial direction Da, which is a direction in which an axis O of the rotor 14 extends. High-temperature steam is supplied into the casing body 121.

The inlet nozzle 122 is connected to a first side Da1 of the axial direction Da with respect to the casing body 121. The inlet nozzle 122 extends from the casing body 121 toward an outer side Dro in a radial direction Dr with respect to the axis O. The inlet nozzle 122 is formed in a cylindrical shape. A steam supply line L1 is connected to the inlet nozzle 122. High-temperature steam generated by a boiler (not shown) is supplied to the inlet nozzle 122 through the steam supply line L1. The high-temperature steam supplied to the inlet nozzle 122 is supplied into the casing body 121.

The outlet nozzle 123 is connected to a second side Da2 of the axial direction Da with respect to the casing body 121. The outlet nozzle 123 extends from the casing body 121 toward the outer side Dro of the radial direction Dr. The outlet nozzle 123 is formed in a cylindrical shape. The outlet nozzle 123 is joined to an outlet path portion 121*a*, which is a space formed at the most second side Da2 of the axial direction Da in the casing body 121. The outlet path portion 121*a* is a space continuous in a circumferential direction Dc around the axis O. A steam discharge line L2 is connected to the outlet nozzle 123. The outlet nozzle 123 discharges steam that has passed through an inside of the casing body 121 to an outside of the casing body 121 through the steam discharge line L2.

The rotor 14 is rotatable about the axis O. The rotor 14 of the present embodiment includes a rotary shaft 15 and rotor blades 16. The rotor 14 is covered by the casing 12 from the outer side Dro of the radial direction Dr. The rotor 14 is rotatably supported with respect to the casing 12.

The rotary shaft 15 is formed in a columnar shape extending in the axial direction Da about the axis O. Both end portions 15*a* and 15*b* of the rotary shaft 15 in the axial direction Da are each rotatably supported around the axis O with respect to the casing 12. The rotary shaft 15 is accommodated into the casing body 121.

A plurality of rotor blades 16 are arranged at intervals in the axial direction Da of the rotary shaft 15. Each rotor blade 16 extends from an outer peripheral surface of the rotary shaft 15 toward the outer side Dro of the radial direction Dr.

A plurality of Stator vanes 18 arranged at intervals in the axial direction Da are fixed to an inner peripheral surface of the casing body 121. The Stator vanes 18 are alternately arranged with the rotor blades 16 at each stage in the axial direction Da.

In such a steam turbine 1, steam generated by a boiler (not shown) is introduced into the casing body 121 from the inlet nozzle 122 through the steam supply line L1. The steam introduced into the casing body 121 flows from the inlet nozzle 122 toward the outlet nozzle 123. When this steam passes through the Stator vane 18 to collide with the rotor blade 16 at each stage of the rotor 14, the rotor blade 16 rotates around the axis O together with the rotary shaft 15. The steam that has reached the outlet path portion 121*a* is discharged from the outlet nozzle 123 to an outside of the casing 12 through the steam discharge line L2. In the casing 12, a pressure of steam gradually decreases from the inlet nozzle 122 at an upstream side toward the outlet nozzle 123 at a downstream side.

Configuration of Cover

The cover 20 is disposed so as to cover a whole of the casing 12 from an outer side thereof. The cover 20 is disposed outside the casing 12. The cover 20 is fixed to the casing 12. The cover 20 forms a hollow path portion R between an outer peripheral surface 12*f* of the casing 12 and the cover 20. The path portion R is a space isolated from a space inside the casing 12. That is, the path portion R and an inside of the casing 12 are not joined to each other, and high-temperature steam flowing into the casing 12 does not directly flow into the path portion R from the inside of the casing 12. The cover 20 of the present embodiment includes a cover body 21, a support member 22, and a connection portion 25.

The cover body 21 is disposed with a spacing with respect to the outer peripheral surface 12*f* of the casing 12. The cover body 21 is formed so as to cover a whole of the outer peripheral surface 12*f* of the casing 12 including the casing body 121, the inlet nozzle 122, and the outlet nozzle 123. The cover body 21 of the present embodiment has a first cover portion 211, a second cover portion 212, and a third cover portion 213. The first cover portion 211 is formed with a substantially constant spacing with respect to the casing body 121 along an outer shape of the casing body 121. The second cover portion 212 is formed with a substantially constant spacing with respect to the inlet nozzle 122 along an outer shape of the inlet nozzle 122. The third cover portion 213 is formed with a substantially constant spacing with respect to the outlet nozzle 123 along an outer shape of the outlet nozzle 123.

The support member 22 supports the cover body 21 with respect to the casing 12 in a non-movable state. The support member 22 connects the cover body 21 and the outer peripheral surface 12*f* of the casing 12. The support member 22 extends from an inner peripheral surface 21*g* of the cover facing the casing 12 toward the outer peripheral surface 12*f* of the casing 12 in the cover body 21. The support member 22 is integrally formed with the cover body 21. The support member 22 is connected to the outer peripheral surface 12*f* of the casing 12 by, for example, welding.

In the present embodiment, the cover 20 has a first connection port 25A and a second connection port 25B as the connection portion 25.

The first connection port 25A is integrally formed with the second cover portion 212. A heating medium supply source 30 is connected to the first connection port 25A via the first connection pipe 26. The heating medium supply source 30 supplies a heating medium H to the path portion R through the first connection pipe 26 and the first connection port 25A. As the heating medium H, for example, high-temperature steam can be used. That is, the heating medium supply source 30 may be, for example, the same device as the boiler that supplies steam to the steam turbine body 10. Furthermore, the heating medium supply source 30 may be a steam supply system that supplies steam to be used in a facility such as a factory where the steam turbine 1 is provided. Moreover, the heating medium H may be any fluid as long as it can heat the path portion R to a high temperature, and for example, hot water or the like may be used in addition to steam.

The second connection port 25B is integrally formed with the third cover portion 213. That is, the second connection port 25B is disposed at a position away from the first connection port 25A. A negative pressure source 40 is connected to the second connection port 25B via the second connection pipe 27. The negative pressure source 40 depressurizes an inside of the path portion R to a vacuum state through the second connection pipe 27 and the second connection port 25B. The negative pressure source 40 may be any device capable of putting the path portion R into a vacuum state. The negative pressure source 40 may be a device independent of the steam turbine body 10 such as an air eject condenser or a vacuum pump, or may be a gland condenser of the steam turbine body 10. Furthermore, the vacuum state in the present embodiment is a state of pressure lower than atmospheric pressure capable of blocking heat transfer from the casing 12 to the cover 20.

A first on-off valve 26*v* is disposed in the middle of the first connection pipe 26. A second on-off valve 27*v* is disposed in the middle of the second connection pipe 27. The steam turbine 1 is capable of supplying a heating medium from the heating medium supply source 30 to the path portion R by switching the first on-off valve 26*v* to an open state. Furthermore, the steam turbine 1 is capable of putting the path portion R into a vacuum state by the negative pressure source 40 by putting the second on-off valve 27*v* in an open state.

Since the heat of the casing 12 heated by steam is transferred, the cover 20 is preferably formed of a material having heat resistance to the temperature of the casing 12. Furthermore, the cover 20 preferably has a strength so as not to be deformed when the path portion R is depressurized. In addition, when the cover 20 is thermally expanded and deformed later than the casing 12 while a high-temperature heating medium such as steam is supplied to the path portion R, the thermal expansion of the casing 12 may cause deformation or damage to the cover 20. Due to this, the cover 20 is preferably formed of a material that deforms at the same time as or earlier than the casing 12. Therefore, the cover 20 is preferably formed of a material having a thermal expansion coefficient equal to or higher than the thermal expansion coefficient of a material forming the casing 12. From these conditions, the cover 20 is preferably formed of a metal material such as stainless steel, for example.

Furthermore, the cover 20 may be divided into a plurality of parts for the convenience of the shape of the cover 20 and the attachment of the cover 20 to the casing 12. In addition, the cover 20 can be formed by, for example, casting or cutting, but may also be formed by, for example, an additive manufacturing method such as a three-dimensional (3D) printer. Moreover, an outer shape of the casing 12 may be formed by a 3D measuring instrument, and the cover 20 may be formed based on the measurement data.

Figure 2:
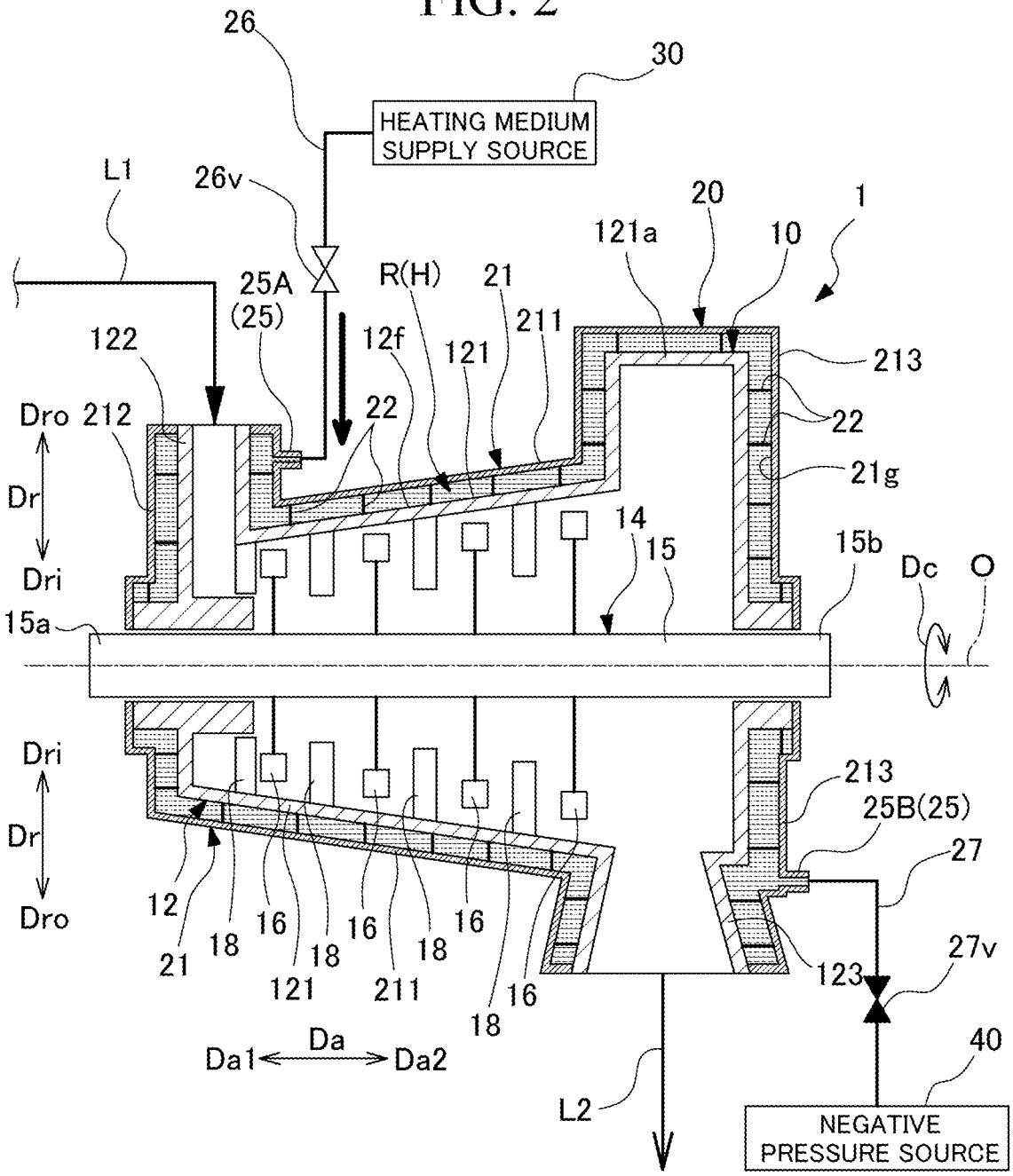
FIG. 2 is a cross-sectional view showing a state in which the steam turbine is started.

As shown in FIG. 2, in case of starting the steam turbine 1, the first on-off valve 26*v* is in an open state, and the second on-off valve 27*v* is in a closed state. Accordingly, the path portion R and the heating medium supply source 30 are connected to each other. As a result, the heating medium H is supplied from the heating medium supply source 30 to the path portion R, and the path portion R is filled with the heating medium H. When the path portion R is filled with the heating medium H, the casing 12 is heated by the heating medium H.

Figure 3:
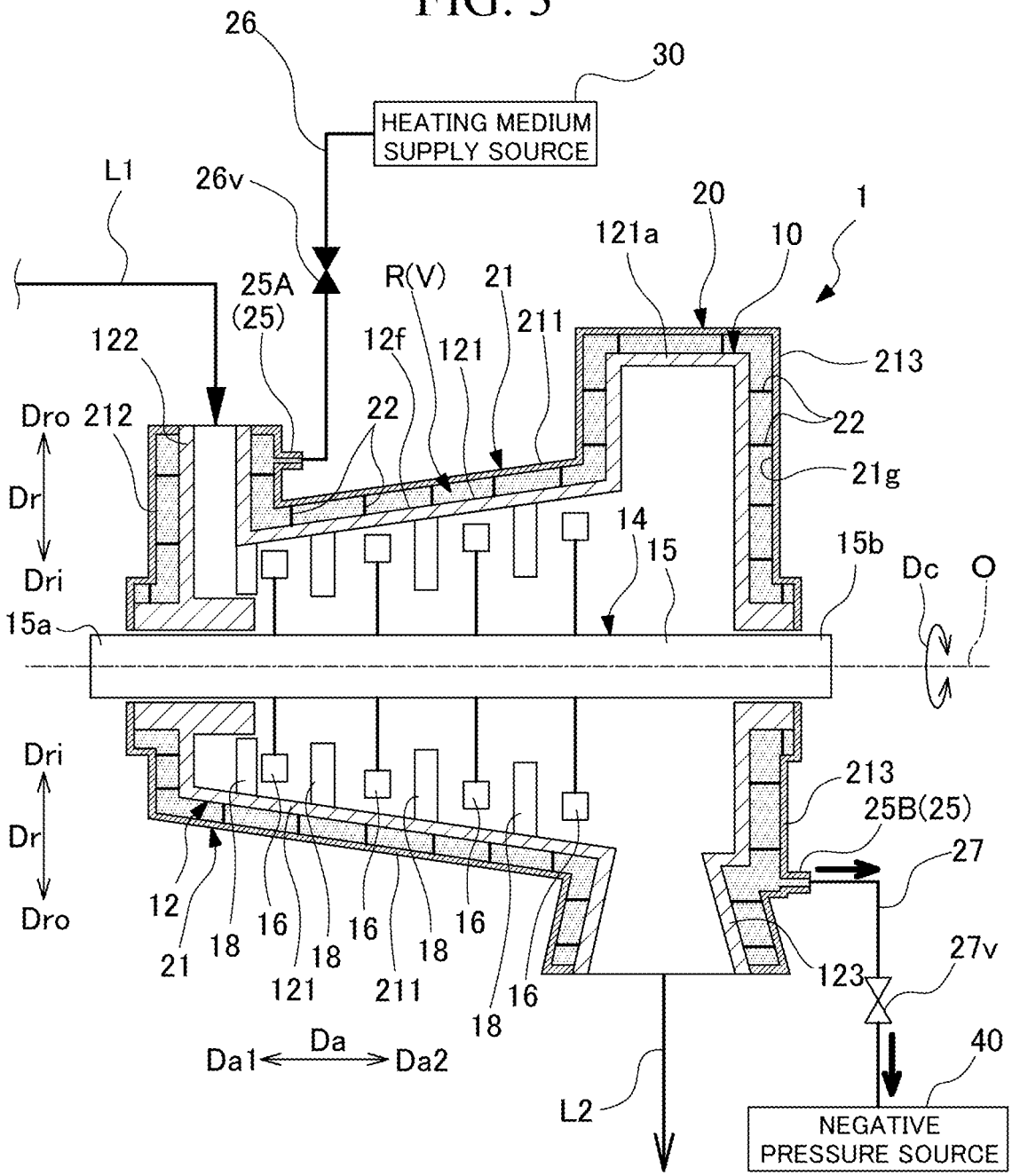
FIG. 3 is a cross-sectional view showing a state in which the steam turbine is operated.

Furthermore, as shown in FIG. 3, in case operating the steam turbine 1 under a specified condition (rated operation, etc.) after the start of the steam turbine 1 is completed, the first on-off valve 26*v* is in a closed state, and the second on-off valve 27*v* is in an open state. Accordingly, an inside of the path portion R is depressurized by the negative pressure source 40 to become a vacuum state. As a result, a heat insulating layer V in a vacuum state is formed between the cover 20 and the casing 12 (an outer side of the casing 12). Accordingly, a space between the casing 12 and the cover 20 is insulated, and the heat of the casing 12 is less likely to be transferred to the cover 20.

Advantageous Effects

In the steam turbine 1 having the above configuration, the path portion R isolated from a space inside the casing 12 is defined between the cover 20 and an outer peripheral surface 12*f* of the casing 12. Furthermore, when an inside of the path portion R is depressurized by the negative pressure source 40 via the second connection portion 25*b* to become a vacuum state, the path portion R becomes the heat insulating layer V. Heat transfer from the casing 12 to the cover 20 is blocked by forming the heat insulating layer V outside the casing 12. Accordingly, when operating the steam turbine 1, the heat of the casing 12 heated by high-temperature steam flowing thereinside is suppressed from being transferred to the cover 20. Accordingly, heat dissipation from the casing 12 to the outside can be suppressed during the operation of the steam turbine 1. In addition, the path portion R can be easily formed between the cover 20 and the casing 12 by attaching the cover 20 to the casing 12. Accordingly, heat dissipation from the casing 12 can be effectively suppressed during the operation of the steam turbine 1 to improve operational efficiency.

Furthermore, since high-temperature steam rises upward in the casing 12 when the steam turbine 1 is started, a temperature difference is likely to occur between an upper part and a lower part of the casing 12. Due to this temperature difference, there is a case where an amount of thermal expansion differs between the upper part and the lower part of the casing 12, and a clearance between the casing 12 and the rotor 14 becomes narrow. Due to this, it is preferable that the temperature of the casing 12 rises more uniformly when the steam turbine 1 is started. On the contrary, in the present embodiment, the heating medium H is supplied from the heating medium supply source 30 into the path portion R via the first connection portion 25*a*. The casing 12 is heated by the heating medium H by filling an inside of the path portion R with the heating medium H. Therefore, when the steam turbine 1 is started, the casing 12 can be heated in advance before supplying steam into the casing 12. Accordingly, when the steam turbine 1 is started, the temperature rise of the casing 12 can be made uniform.

Furthermore, the cover body 21 is supported by the support member 22 with a spacing with respect to the outer peripheral surface 12*f* of the casing 12. Accordingly, the cover body 21 is attached to the casing 12 in a shape that does not easily collapse by attaching the cover body 21 to the casing 12. Therefore, the path portion R having a stable shape can be easily formed between the cover 20 and the casing 12.

Other Embodiments

While preferred embodiments of the invention have been described and illustrated above, it should be understood that these are exemplary of the invention and are not to be considered as limiting. Additions, omissions, substitutions, and other modifications can be made without departing from the scope of the invention. Accordingly, the invention is not to be considered as being limited by the foregoing description and is only limited by the scope of the appended claims.

In addition, in the above embodiment, the cover body 21 of the cover 20 is formed with a substantially constant spacing along the outer peripheral surface 12*f* of the casing 12, but the present disclosure is not limited to such a configuration. The cover body 21 may have any shape and spacing with respect to the outer peripheral surface 12*f* of the casing 12 as long as the path portion R is defined between the outer peripheral surface 12*f* of the casing 12 and the cover body 21.

Furthermore, in the above embodiment, the connection portion 25 includes the first connection port 25A to which the heating medium supply source 30 is connected and the second connection port 25B to which the negative pressure source 40 is connected, but the present disclosure is not limited to such a configuration. The heating medium supply source 30 and the negative pressure source 40 may be selectively connected to the connection portion 25 including one connection port by a switching valve or the like.

Supplement

The steam turbine 1 according to the embodiment is understood as follows, for example.

(1) The steam turbine 1 according to a first aspect includes a rotor 14 that is configured to rotate about an axis O, a casing 12 that covers the rotor 14 from an outer side Dro in the radial direction Dr with respect to the axis O, and a cover 20 disposed outside the casing 12 to form a hollow path portion R between an outer peripheral surface 12*f* of the casing 12 and the cover 20, in which the cover 20 is connected to a negative pressure source 40 configured to put the path portion R into a vacuum state, and the path portion R is a space isolated from a space inside the casing 12.

Examples of the heating medium H include steam and hot water.

Examples of the heating medium supply source 30 include a steam supply system that supplies steam at a facility where a boiler or the steam turbine 1 is provided.

Examples of the negative pressure source 40 include a gland condenser, an air eject condenser, and a vacuum pump.

Accordingly, when an inside of the path portion R is depressurized by the negative pressure source 40 to become a vacuum state, the path portion R becomes a heat insulating layer V. Heat transfer from the casing 12 to the cover 20 is blocked by forming the heat insulating layer V outside the casing 12. Accordingly, when operating the steam turbine 1, the heat of the casing 12 heated by high-temperature steam flowing thereinside is suppressed from being transferred to the cover 20. Accordingly, heat dissipation from the casing 12 to the outside can be suppressed during the operation of the steam turbine 1. Accordingly, heat dissipation from the casing 12 can be effectively suppressed during the operation of the steam turbine 1 to improve operational efficiency.

(2) The steam turbine 1 according to a second aspect is the steam turbine 1 of (1), in which the cover 20 is connected to a heating medium supply source 30 configured to supply a heating medium H to the path portion R.

Accordingly, the heating medium H is supplied from the heating medium supply source 30 into the path portion R. The casing 12 is heated by the heating medium H by filling an inside of the path portion R with the heating medium H. Therefore, when the steam turbine 1 is started, the casing 12 can be heated in advance before supplying steam into the casing 12. Accordingly, when the steam turbine 1 is started, the temperature rise of the casing 12 can be made uniform.

(3) The steam turbine 1 according to a third aspect is the steam turbine 1 of (1) or (2), in which the cover 20 includes a cover body 21 disposed with a spacing with respect to the outer peripheral surface 12*f* of the casing 12, and a support member 22 that extends from a cover inner peripheral surface 21*g* of the cover body 21 facing the casing 12 toward the outer peripheral surface 12*f* of the casing 12 and is connected to the casing 12 and the cover body 21.

Accordingly, the cover body 21 is attached to the casing 12 in a shape that does not easily collapse by attaching the cover body 21 to the casing 12. Therefore, the path portion R having a stable shape can be easily formed between the cover 20 and the casing 12.

EXPLANATION OF REFERENCES

1: Steam turbine
10: Steam turbine body
12: Casing
12*f*: Outer peripheral surface
121: Casing body
121*a*: Outlet path portion
122: Inlet nozzle
123: Outlet nozzle
14: Rotor
15: Rotary shaft
15*a*, 15*b*: End portion
16: Rotor blade
18: Stator vane
20: Cover
21: Cover body
21*g*: Cover inner peripheral surface
211: First cover portion
212: Second cover portion
213: Third cover portion
22: Support member
25: Connection portion
25A: First connection port
25B: Second connection port
26: First connection pipe
26*v*: First on-off valve
27: Second connection pipe
27*v*: Second on-off valve
30: Heating medium supply source
40: Negative pressure source
Da: Axial direction
Da1: First side
Da2: Second side
Dc: Circumferential direction
Dr: Radial direction
Dro: Outer side
L1: Steam supply line
L2: Steam discharge line
O: Axis
R: Path portion
H: Heating medium
V: Heat insulating layer

What is claimed is:

1. A steam turbine comprising:
a rotor that is configured to rotate about an axis;
a casing that covers the rotor from an outer side in a radial direction with respect to the axis; and
a cover disposed outside the casing to form a hollow path portion between an outer peripheral surface of the casing and the cover, wherein
the cover is connected to a negative pressure source configured to put the path portion into a vacuum state, and
the path portion is a space isolated from a space inside the casing.

2. The steam turbine according to claim 1, wherein
the cover is connected to a heating medium supply source configured to supply a heating medium to the path portion.

3. The steam turbine according to claim 1, wherein
the cover includes:
a cover body disposed with a spacing with respect to the outer peripheral surface of the casing, and
a support member that extends from a cover inner peripheral surface of the cover body facing the casing toward the outer peripheral surface of the casing and is connected to the casing and the cover body.

* * * * *